United States Patent [19]

Abraham et al.

[11] Patent Number: 4,777,486

[45] Date of Patent: Oct. 11, 1988

[54] VIDEO SIGNAL RECEIVER FOR COMPUTER GRAPHICS SYSTEM

[75] Inventors: Arthur Abraham, Oakland; George A. Ellis, Jr., San Francisco, both of Calif.

[73] Assignee: A-Squared Systems, Oakland, Calif.

[21] Appl. No.: 861,695

[22] Filed: May 9, 1986

[51] Int. Cl.[4] ..... G09G 1/02

[52] U.S. Cl. ..... 340/799; 340/747; 364/521

[58] Field of Search ..... 340/747, 750, 799; 364/521

[56] References Cited

U.S. PATENT DOCUMENTS

| | | | |
|---|---|---|---|
| 4,550,315 | 10/1985 | Bass et al. | 340/747 |
| 4,609,917 | 9/1986 | Shen | 340/747 |
| 4,635,049 | 1/1987 | Dodge et al. | 340/747 |
| 4,660,029 | 4/1987 | Houda et al. | 340/747 |
| 4,667,190 | 5/1987 | Fant | 340/747 |
| 4,670,752 | 6/1987 | Marcoux | 340/747 |

*Primary Examiner*—Howard A. Birmiel

*Attorney, Agent, or Firm*—Flehr, Hohbach, Test, Albritton & Herbert

[57] ABSTRACT

A video image processing system and method for encoding and storing a video image in a bit map array. The system receives a raster scan video signal which it converts into an analog luminosity signal. Then, during each of a preselected repeating sequence of raster scan cycle periods, it encodes a corresponding preselected portion of the information in the analog luminosity signal as a binary value and stores the value in a bit map memory array. As a result, the video image is encoded and stored over a plurality of raster scan cycle periods.

15 Claims, 4 Drawing Sheets

VIDEO SIGNAL RECEIVER FOR COMPUTER GRAPHICS SYSTEM

The present invention relates generally to computer graphics systems, and particularly to an apparatus and method for receiving video signals and storing the corresponding pictures in a bit-mapped computer graphics system.

BACKGROUND OF THE INVENTION

The present invention provides a low cost system and method for receiving and storing raster scan video signals in a bit-mapped computer graphics system. The preferred embodiment was designed to be added to low cost personal computer systems having bit-mapped graphics capability. Other embodiments of the invention could be designed for use with virtually any bit-mapped graphics system.

The preferred embodiment allows the user to view a video picture on the monitor of a personal computer, to adjust the contrast of the picture, to adjust the coloring of the picture, and to store a selected picture or image for later use. The stored picture can then be modified or added to using graphics software of the type which is already widely used on personal computer systems.

A feature of the present invention is the use of a relatively simple sequential process for storing a raster scan video signal which avoids the need to simultaneously process all of the information in the video signal. In particular, a preselected portion of the video information, such as one fifth of the relevant information, can be processed during each raster scan cycle. This feature allows significant reductions in the cost of the system by reducing the speed and complexity of the circuitry used.

Another feature of the present invention is that the bit-mapped image generated by the system is stored using a cyclic encoding technique which reduces or minimizes "digitization jitter"—the tendency of the image to noticeably fluctuate, especially along the boundaries of objects and along other color and brightness boundaries.

It is therefore a primary object of the present invention to provide a system and method for receiving and storing video images in a bit-mapped computer graphics system.

Other objects of the present invention include the provision of a low cost system having the above described features, and the minimization of digitization jitter.

SUMMARY OF THE INVENTION

In summary, the present invention is a video image processing system and method for encoding and storing a video image in a bit map array. The system receives a raster scan video signal which it converts into an analog luminosity signal. Then, in a preselected repeating sequence of raster scan cycle periods, it encodes at least a preselected portion of the information in the analog luminosity signal as a binary value and stores the value in a bit map memory array. As a result, the video image is encoded and stored over a plurality of raster scan cycle periods.

In a preferred embodiment of the invention, the luminosity signal generated by the system includes three separate color luminosity signals. Each of the color luminosity signals is separately encoded as a multibit binary value during different raster scan cycle periods, and at least one bit of each color luminosity signal is stored in the bit map memory array. Also, the color luminosity signals are cyclically encoded so that only one bit of each multibit binary value changes in value when the intensity of the corresponding color luminosity signal changes by an amount corresponding to the value of the least significant bit of the multibit binary value.

BRIEF DESCRIPTION OF THE DRAWINGS

Additional objects and features of the invention will be more readily apparent from the following detailed description and appended claims when taken in conjunction with the drawings, in which:

DESCRIPTION OF THE PREFERRED EMBODIMENT

Figure 1:
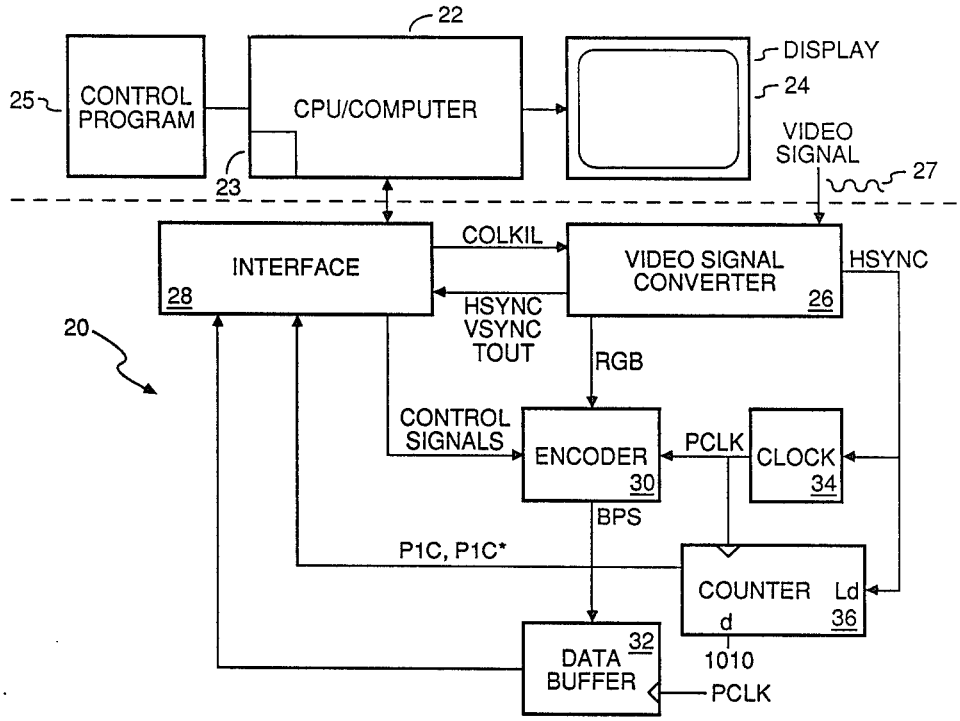
FIG. 1 is a block diagram of a video image processing system in accordance with the present invention.

Referring to FIG. 1, there is shown a video processing system 20 for use with a computer or central processing unit (CPU) 22 which is coupled to a monitor or similar display device 24. The computer 22 includes a standard bit mapped memory 23 for retaining video images. The computer 22 also uses a control program 25 for setting up the video signal encoding system 20 and for reading and storing the data generated by the encoding system 20. In the preferred embodiment the computer 22 is an Amiga Personal Computer, Model 1000.

The purpose of the video processing system 20 is to receive a video signal 27, for use in a standard television, and to encode the video signal 27 so that it can be stored in the computer 22. The apparatus and method for performing this function are described below.

BACKGROUND INFORMATION ABOUT VIDEO SIGNALS

For those unfamiliar with television signals, it will be helpful to know that standard television signals are formatted as raster scan video signals which paint an image on a cathode ray tube device by sweeping across the screen left to right and top to bottom. In the United States, the television signal scans the screen sixty times per second, but refreshes the entire image only thirty times per second because the screen is divided into two sets of interlaced horizontal lines which are refreshed during alternate scan cycles.

Video images are commonly stored in computers in a memory array 23 called a bit map. The image is represented as a two dimensional array of pixels (image points)—each of which is represented by a binary value in the bit map. In the preferred embodiment, the computer 22 stores images in a bit map which is 320 pixels (or columns) wide and 200 pixels (or rows) high.

From a technical viewpoint, the bit map video memory comprises an m by n by z array of binary memory bits, where m is the maximum width of the image, measured in pixels, that can be stored in the video memory, n is the maximum height of the image, measured in pixels, that can be stored in the video memory, and z is the maximum number of bits which can be used to encode each pixel of the image stored in the video memory. Each of the z bits for all of the pixels represents a bit plane across the image stored in the video memory. In the preferred embodiment, the computer's video memory includes an access port for simultaneously storing one bit of data in any selected bit plane for each of sixteen contiguous pixels on a single scan line.

The stored video image can be either a black and white image or a color image. The bit mapped video memory 23 in the computer 22 will generally include at least five binary bits of memory for storing each pixel of the stored video image. In the preferred embodiment, four bits are used to encode the pixels of black and white images (thereby providing sixteen gradations from black to white); five bits are used to encode the pixels of color images: two for red, two for green and one for blue.

MAIN COMPONENTS OF VIDEO PROCESSING SYSTEM

A video signal converter 26 receives a raster scan video signal 27 and generates several derivative signals: R, G and B analog signals corresponding to the luminosity of the red, green and blue components of the video signal 27; HSync (Horizontal Synchronization), which becomes active just before the video signal sweeps a new horizontal scan line; VSync (Vertical Synchronization), which becomes active just before the video signal begins painting a new field of video data; and TOUT (Timeout), which becomes active if no video signal 27 is detected for a period exceeding a predefined time limit, such as two normal raster scan cycles.

The video signal 27 is typically derived from the "video out" port of a standard television or video cassette recorder. Such video signals are similar to broadcast television signals, except that the carrier frequency has been removed.

An interface 28 provides a path for communications between the video processing system 20 and the computer 22. The computer 22 uses the interface 28 to send control signals which, as will be described in more detail below, instruct the system 20 on how to process the video signal being received. The system 20 uses the interface 28 to send binary encoded video data back to the computer 22.

One of the control signals sent by the computer 22 to the system 20 is the COLKIL signal, which instructs the video signal converter 26 to treat the video signal 27 as a color signal if COLKIL equals one (i.e., 5 volts), and as monochrome (black and white) signal if COLKIL equals zero (i.e., zero volts). When COLKIL equals zero, the R, G and B signals generated by the video signal processor 26 are all equal to the overall luminosity of the video image corresponding to the video signal 27.

As will be explained later, the computer 22 also uses the interface 28 to control which portion of the video signal 27 is to be encoded. For instance, the computer 22 instructs the system 20 on which of the three color signals (R, G, and B) to encode.

In addition, the computer 22 uses the interface to adjust the contrast control of the system 20, to map any preselected color into "the transparent color", and to synchronize the computer 22 with the horizontal and vertical scan rates of the raster scan video signal 27 being encoded.

The encoder 30 encodes a selected portion of the information in the video signal 27 and stores the resulting encoded video data in a data buffer 32. The data buffer 32 is a sixteen bit shift register with parallel outputs coupled to a latch in the interface 28.

A clock 34 generates a square wave signal labelled PCLK which has a cycle time equal to the time it takes the video signal 27 to sweep past one pixel of the corresponding image. The encoder 30 responds to the PCLK signal by encoding one pixel during each cycle of PCLK; the data buffer 32 stores the encoded valued of one pixel each time PCLK has an upward transition.

A counter 36 is coupled to the clock 34 and generates a signal labelled P1C once every sixteen PCLK cycles. The P1C signal causes the contents of the data buffer 32 to be stored in a latch in the interface 28. The counter 36 also generates the boolean complement of P1C, P1C*, for use in the interface 28.

At the beginning of each horizontal scan line the counter 36 is set by the HSync signal to a predetermined value (e.g. ten, which is 1010 in base 2). This value is selected so as to synchronize the counter 36 and the system 20 with the receipt of video data in the video signal 27.

In review, the system 20 is a video signal encoder which automatically encodes and transmits to computer 22 a selected portion of the information in the video signal 27 received by the system.

In the preferred embodiment, the computer 22 is programmed to change the portion of the information encoded after each frame of video data is encoded so that the system systematically and repetitively encodes a specified sequence of information portions—thereby building up a completely encoded video image over a period of several video frames. The effect of this programmed encoding sequence is that the image viewed on the display 24 of the computer system 22 is updated at a fraction (e.g., one-fourth or one-fifth) of the normal update rate. However, since the normal update rate is thirty or sixty times per second (depending on whether alternate interlaced frame cycles are skipped or overlapped with the other frame cycles), the resulting update rate for the encoded image is still several cycles per second.

ENCODER

Figure 2:
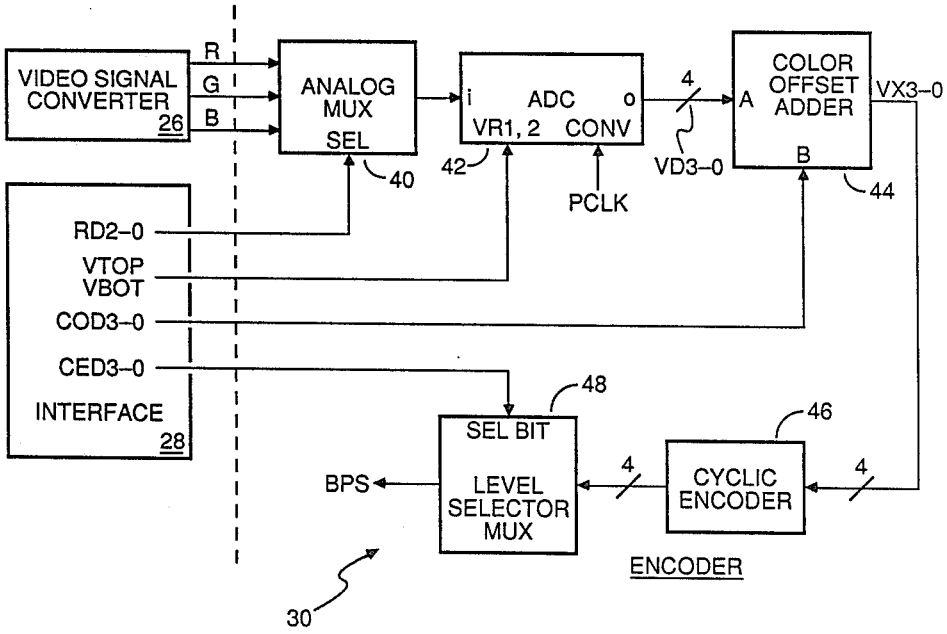
FIG. 2 is a block diagram of a video data encoder.

Referring to FIGS. 1 and 2, the computer sends a three bit signal labelled RD2-0 to the system 20 to indicate which of the three color luminescence signals R, G and B produced by the video signal converter 26 is to be encoded. Only one of the three bits is allowed to be enabled (equal to one) at any one time. RD0 enables encoding of the Blue luminescence signal, RD1 the Red, and RD2 the Green.

The RD2-0 signal is used by an analog multiplexer 40 in the encoder 30 to enable one of the three color luminescence signals R, G and B produced by the video signal converter 26 to be transmitted to the input port of an analog to digital converter (ADC) 42 which digitizes the analog luminescence signal into a four bit binary value VD3-0 once each pixel cycle (i.e., a new conversion is performed each time the PCLK clock signal is enabled).

The ADC 42 converts the analog luminescence signal into a four bit value by comparing the input signal with two reference signals labelled VTop and VBot and determining where in the range between these two reference signals the input signal falls. The VTop and VBot signals are generated by two digital to analog converters in the interface 28 which convert binary control signals labelled VRD7-4 and VRD3-0 from the computer 22 into analog d.c. voltage signals.

A four bit binary value COD3-0 sent by the computer 22 through the interface 28 is added to the binary video data value VD3-0 by an adder 44 called the color offset adder. As will be understood by those skilled in the art, the COD3-0 parameter can be used by the computer 22 to map any preselected color into the color which is treated by the computer 22 as transparent. In the preferred embodiment, the value of COD3-0 can be selected so that any preselected color value (such as 10111) is mapped into the color represented by zero (i.e., 00000) which is used to represent transparent image areas in the Amiga computer used in the preferred embodiment. (Note that the value of COD3-0 must be selected so that the desired transformation is obtained after taking into account the cyclic encoding, discussed below.)

Next, the output from the color offset adder 44 is re-encoded by a cyclic encoder 46. From a simple cause and effect viewpoint, the purpose of the cyclic encoder 46 is to ensure a smooth transition in the binary value of the encoded value each time the value is incremented or decremented. This means that when the four bit value is incremented or decremented by one, only one of the encoded bits changes in value. Stated technically, only one bit of the encoded binary luminosity signal changes in value when the intensity of the corresponding color luminosity signal changes by an amount corresponding to the value of the least significant bit of the multibit binary value.

From a practical viewpoint, the purpose of the cyclic encoder 46 is to reduce the amount of noise in the encoded image by preventing all of the encoded bit from dithering (rapidly changing in value back and forth) when the corresponding luminescence signal fluctuates in value by a slight amount.

Figure 3:
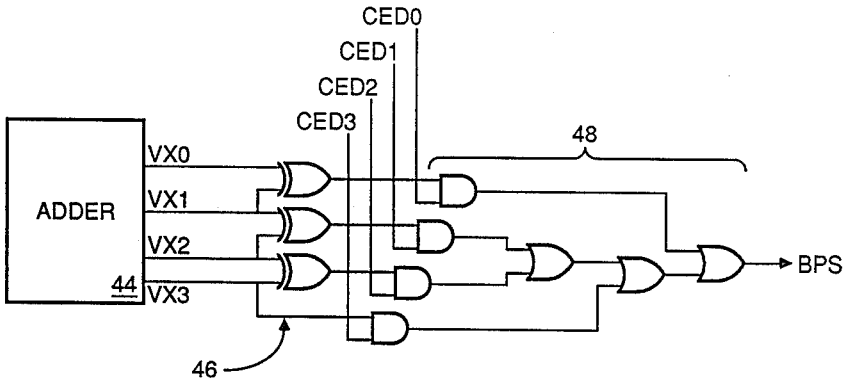
FIG. 3 is a circuit diagram of a cyclic encoder and bit level selector multiplexer.

The actual cyclic conversion circuit 46 used consists of three exclusive OR gates which combine each of the three adjacent bit values VX1-0, VX2-1 and VX3-2 from the adder 44, as shown in FIG. 3. The effect of this circuit 46 on the encoded data is shown in Table 1, below.

As will be understood by those skilled in the art, the computer 22 will generally have a color key or color map which maps each color value (such as 10111) into any preselected color that the system is capable of displaying. Therefore, the transformation of the encoded data by the cyclic encoder 46 need not affect the intensity nor color of the image displayed on the computer's display 24—because the color map of the computer can be adjusted to compensate for the effect of the cyclic encoder. The only effect of the cyclic encoder will be to reduce jitter in the encoded image.

In the preferred embodiment, only the most significant bit or two bits of each color luminescence signal are used when color images are being encoded. Therefore, as a quick inspection of Table 1 will show, the distortions generated by using the cyclic encoder 46 are relatively minor. Note that in other embodiments of the invention, other combinations of bits from the R, G and B luminescence signals could be stored in the computer 22 to generate different special effects; generally, however, at least one bit from each color luminescence signal will be stored in the computer 22.

Finally, one of the four bits generated by the cyclic encoder 46 is selected by multiplexer 48 for storage in the data buffer 32. The bit to be stored, labelled BPS, is selected by the computer 22 by enabling the corresponding bit in the CED3-0 signal. The selection circuit 48 used in the preferred embodiment is shown in FIG. 3.

INTERFACE

Figure 4:
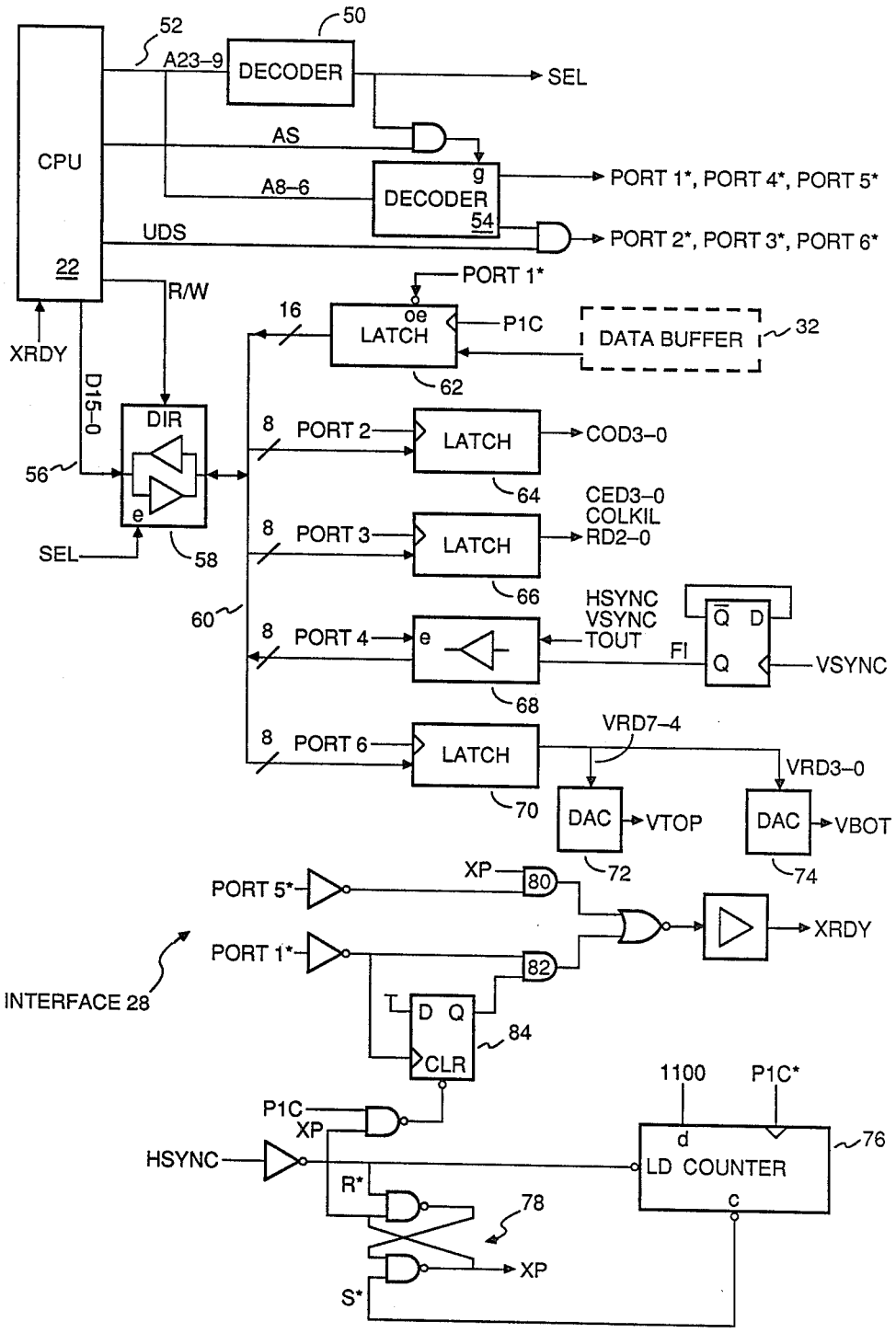
FIG. 4 is a block diagram of the computer interface used in the preferred embodiment of the present invention.

Referring to FIG. 4, there is shown a block diagram of the interface 28 in the preferred embodiment. The interface 28 has six modes of operation, each of which is enabled when the corresponding Port signal (Port1, . . . Port6) is activated or enabled. These modes of operation are controlled by the address signal transmitted by the computer 22 on its address bus 52.

The interface 28 as a whole is enabled only when a preselected address value (e.g., EF70) is set up on the high order address lines A23–A9. When decoder 50 detects the presence of this preselected value, it activates the SEL signal. When both SEL and the address strobe signal AS from the computer 22 are active, the value of the A8–A6 address lines are strobed into decoder 54. The binary value of A8–A6 is decoded in standard fashion to enable one of the Port signals. Thus the Port1* signal is activated when A8–A6 equals 001, the Port2 signal is activated when A8–A6 equals 010, and so on.

Note that Port1*, Port4* and Port5* are negative logic signals which are active when low and inactive when high. The Port2, Port3 and Port6 signals are normal logic signals, but these signals are active only when the UDS signal from the computer 22 is active because this signals are used to strobe in data from the computer's data bus 56.

The interface's internal data bus 60 is coupled to the computer's data bus 56 by a bidirectional buffer 58 which has a data path sixteen bits wide. This buffer 58 is enabled only when SEL is active, and the direction that data flows through the buffer 58 is determined by the R/W signal from the computer 22. (When R/W is high, data flows through the buffer 58 from the interface to the computer 22.)

The sixteen bits of data stored in the data buffer 32 are transferred into latch 62 when the P1C signal becomes active (once each sixteen pixel cycles). This data is then transmitted onto the interface's internal data bus 60 when Port1* is activated. From there, the computer 22 can read the video data and store it in the appropriate location in its video memory 23.

When Port2 is activated, four bits of data labelled COD3-0 sent by the computer 22 are stored in latch 64. As described above, the value of COD3-0 is added by adder 44 to the raw binary value of the luminescence signal being encoded.

When Port3 is activated, eight bits of data labelled CED3-0, COLKIL and RD2-0 sent by the computer 22 are stored in latch 66. The functions of each of these data signals are described above.

When Port4 is activated, the HSync, VSync, and TOUT signals from the video signal converter 26 are transmitted through buffer 68 onto the data bus 60 for reading by the computer 22. A binary signal called FI (Field Index), which flips value each raster scan cycle, is also transmitted through buffer 68 onto the data bus 60. The use of these signals allows the computer 22 to synchronize itself with the raster scan signal by enabling it to detect when horizontal blanking occurs and when vertical blanking is about to end. The computer 22 can also read TOUT to determine if the system 20 is not receiving a video signal 27, and can use FI to help it distinguish between the two raster scan cycles it takes to refresh the video image.

When Port6 is activated, eight bits of data labelled VRD7-0 sent by the computer 22 are stored in latch 70. These eight bits are divided into two nibbles, VRD7-4 and VRD3-0, which are converted by digital to analog converters (DACs) 72 and 74 into analog signals VTop and VBot, respectively. The VTop and VBot signals are used by ADC 42 as reference signals which control the contrast sensitivity of the encoded image.

Port5* is used to synchronize the computer with the beginning of a horizontal scan line as follows. First, it should be noted that by pulling the computer's XRDY line down, a peripheral such as system 20 can suspend operation of the computer 22. This facility can be used to synchronize the computer 22 with an external process, such as the sweeping of a raster scan video signal.

One unusual aspect of the present invention is that the computer 22 itself (rather than a peripheral device) causes the XRDY line to be pulled low. In effect, the computer 22 is programmed to disable itself until the beginning of the next scan line.

The XP signal is used to delay the transmission of video data to the computer 22 until the fourth sets of sixteen pixels in each horizontal scan line has been received. This works as follows. Counter 76 is loaded with a value of twelve (i.e., 1100 in base 2) by HSync at the beginning of each scan line. At the same time, the HSync signal goes to the R* input line to RS flip flop 78. This resets the flip flop 78, which makes XP go low.

After four P1C cycles, the first of which is four pixel cycles long and the rest of which are sixteen pixel cycles long, the counter 76 overflows and generates a carry signal on the S* input line to RS flip flop 78. This sets the flip flop 78, which makes XP go high. Since the negative logic P1C* signal is used to clock the counter 76, XP isn't set until just after the beginning of the fourth set of sixteen pixels from the current scan line begins to be encoded.

Thus XP is normally high, except for the period of time during which the first three sets of sixteen pixels are being received by the system 20. After a preselected number (e.g., twenty) of sets of video data from a single scan line have been read by the computer 22, the computer 22 activates Port5*. Since XP is high at this point in the scan line, AND gate 80 is enabled. Therefore, when Port5* is activated, XRDY is pulled low. This disables the computer 22 until the next HSync signal resets XP, which disables AND gate 80 and releases XRDY—which allows the computer 22 to resume operation. XRDY is also used to synchronize the computer with the flow of video data from each horizontal scan line as follows. Whenever the computer 22 wants to read another sixteen bits of video data, it activates Port1*. Since flip flop 84 is set by the Port1* signal, AND gate 82 is enabled and XRDY is pulled low. This disables the computer 22 until the next P1C signal is generated—which clears flip flop 84 if XP is active. If XP is inactive, the system 20 waits until counter 76 counts past the first forty-eight pixels in the scan line and activates XP.

When flip flop 84 is cleared by P1C, AND gate 82 is disabled and XRDY is released—whereupon the computer 22 immediately reads in the sixteen bits of video data stored in latch 62.

After a preselected amount of video data (e.g., 320 pixels or bits) is read from a horizontal scan line the computer stops this process by activating Port5* instead of Port1*.

After a preselected number of lines of video data (e.g., 200) are read, the computer stops the reading process altogether. The computer then has a short period of time (generally at least one millisecond) to update the parameters used by the video encoding system 20 through the use of Port2, Port3 and Port6. Then Port4* is activated so that the computer 22 can detect VSync and can thereby synchronize itself with the beginning of the next frame of video data.

Raster scan interlace can be accommodated in at least three distinct ways. First, the computer 22 can be programmed to use the video encoding system 20 to encode only every other frame, which slows down the system but avoids dealing with the interlace pattern. Second, the computer 22 can be programmed to use the system 20 to encode every frame and to treat each pair of neighboring interlaced scan lines as a single scan line by storing the data for both lines in the same memory location. This speeds up the encoding process but can result in some jittering in the stored image due to differences in the image between neighboring interlaced scan lines. Third, the computer 22 can be programmed to use the system 20 to encode every frame, but to treat each pair of neighboring interlaced scan lines as separate scan lines which are to be stored as neighboring lines of pixels in the video memory—which means that computer 22 mimics the interlace scan pattern by storing the encoded video data during each scan cycle in the memory locations for every second scan line.

VIDEO ENCODING AND STORAGE METHOD

Figure 5:
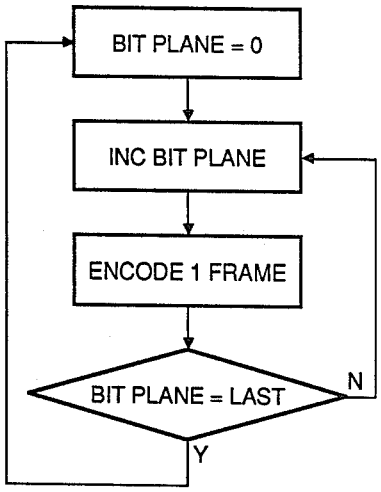
FIGS. 5, 6, and 7 are flow charts of the method of the present invention.

Referring to FIG. 5 the method of the present invention is to encode the incoming video signal data by encoding, in sequence, a preselected portion (e.g., one preselected bit) of the information for every pixel in the image being encoded; then another preselected portion, and so on until all the preselected portions have been encoded, at which point the process repeats.

Figure 6:
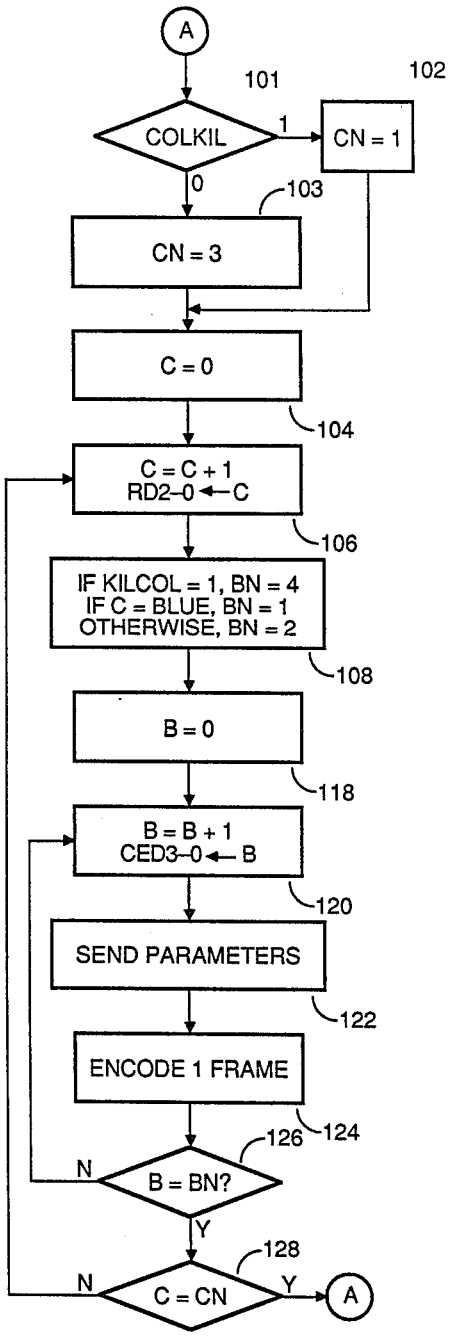

Referring to FIG. 6, in the preferred embodiment the process used is as follows. First, if COLKIL is equal to one (box 101), the image is to be treated as a black and white image and only one color luminescence signal need be encoded (box 102); otherwise all three color signals woll be encoded (box 103).

Then the following process is performed for each color luminescence signal (boxes 104 and 106) to be encoded. The parameter RD2-0 is set to the color signal to be encoded (box 106). Depending on the clor signal to be encoded and whether the video signal is color or black and white, the parameter BN is et equal to the number of bits of data which will be encoded for the selected color signal (box 108).

Next, the following process is preformed for each bit of the selected color signal which will be encoded (boxes 118 and 120). CED3-0 is set up to select the proper bit for storage by the computer 22 (box 120). Then the parameters used by the video encoding system are updated using Ports 2, 3 and 6 (box 122). Port 6 is always used at this point because the video encoding system 20 must be told which color luminescence signal to encode, whether the system is to operate in color mode, and which bit of the encoded value is to be stored. Ports 2 and 3 are used if the corresponding parameters have been updated since the last time they were sent to the system 20.

After the parameters have been sent to the system 20, one frame of video data is encoded (box 124). Then, if there are more bits to be stored for the selected color signal (box 126), the process loops back to box 120. Otherwise the process checks to see if all the color luminescence signals have been encoded and stored (box 128). If not, the process loops back to box 106 to encode the next color; otherwise it loops back to the beginning of the process at box 101.

Figure 7:
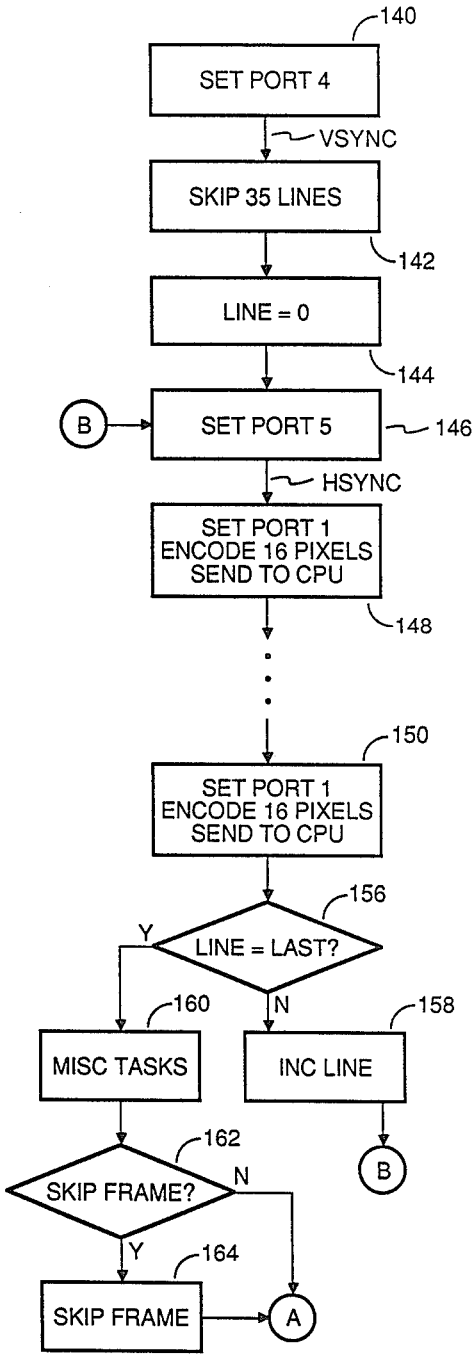

Referring to FIG. 7, there is shown a flow chart for the process of encoding one frame of data (box 124 in FIG. 7) after the color selection and bit plane selection parameters have already been sent by the computer 22 to the video encoding system 20.

First Port 4 is activated (box 140) to enabled the computer 22 to detect the beginning of a new frame by reading the VSync signal. When VSync is detected, the system software skips over the first thirty-five or so horizontal lines (which do not comprise part of the actual video picture) by asserting Port 5 the appropriate number of times (box 142).

Then the system prepares to read the first line of video data by setting Line to zero (box 144) and enabling Port 5 (box 146)—which disables the computer 22 until HSync. Upon receipt of HSync, the computer reads in twenty sets of video data (boxes 148 to 150) by repeating the process of asserting Port 1 and reading in the video data encoded by the system 20 twenty times.

After the last set of video data in the scan line has been encoded and read by the computer 22 (box 150) the computer checks to see if the scan line just encoded is the last one in the frame to be encoded (box 156). If not, the Line parameter is incremented (box 158) and the process resumes at box 146; otherwise the computer 22 has one or more milliseconds to perform miscellaneous tasks (box 160) before preparing to encode a new frame of data, starting at box 101 in FIG. 6. However, if the computer 22 is programmed to skip every other frame to avoid the raster scan interlacing of scan lines (box 162), then the computer 22 uses Port 4 to wait for a VSync signal before allowing the process to continue—thereby causing the process to skip one frame (box 164).

In summary, the process of the invention is a combination of (1) steps performed by the computer 22 to set up the video encoding system 20, (2) steps performed by the video encoding system 20 to encode the video signal being received, and (3) steps performed by the computer 22 to read and properly store the encoded video data.

OTHER EMBODIMENTS

While the present invention has been described with reference to a few specific embodiments, the description is illustrative of the invention and is not to be construed as limiting the invention. Various modifications may occur to those skilled in the art without departing from the true spirit and scope of the invention as defined by the appended claims.

TABLE 1

CYCLIC ENCODING

| Decimal Value | Binary Value from Adder | Cyclic Value | Normal Decimal Value of Cyclic Value |
|---|---|---|---|
| | VVVV | | |
| | XXXX | | |
| | 3210 | | |
| 0 | 0000 | 0000 | 0 |
| 1 | 0001 | 0001 | 1 |
| 2 | 0010 | 0011 | 3 |
| 3 | 0011 | 0010 | 2 |
| 4 | 0100 | 0110 | 6 |
| 5 | 0101 | 0111 | 7 |
| 6 | 0110 | 0101 | 5 |
| 7 | 0111 | 0100 | 4 |
| 8 | 1000 | 1100 | 12 |
| 9 | 1001 | 1101 | 13 |
| 10 | 1010 | 1111 | 15 |
| 11 | 1011 | 1110 | 14 |
| 12 | 1100 | 1010 | 10 |
| 13 | 1101 | 1011 | 11 |
| 14 | 1110 | 1001 | 9 |
| 15 | 1111 | 1000 | 8 |

What is claimed:

1. Video image receiving apparatus for receiving a video image in the form of a raster scan video signal and for encoding and storing the video image in a bit map memory array coupled to said video image receiving apparatus; the raster scan video signal having a predefined raster scan cycle period during which time the raster scan video signal can be used to refresh the entire display of a raster scan display device; said video image receiving apparatus comprising:

video receiving means for receiving a video image in the form of a raster scan video signal and generating a corresponding luminosity signal containing information representing the received video image;

encoding means, coupled to said video receiving means, for encoding said luminosity signal, over the course of a plurality of successive raster scan cycle periods, as an array of pixels values, each said pixel value including a multiplicity of bit values, each bit value representing a portion of the information in said luminosity signal;

said encoding means including means for encoding a portion of the information in said luminosity signal so as to generate a subset of said bit values for every pixel value in said array of pixel values during each of a plurality of successive raster scan cycle periods, and means for changing said portion during successive raster scan cycles periods so that all of said bit values for said array of pixel values are generated during a plurality of successive raster scan cycle periods; and storage means, coupled to said encoding means, for storing said array of pixel values generated by said encoding means in a bit map memory array coupled to said video image receiving apparatus; the bit map memory array having a multiplicity of elements, each element of the array having a multiplicity of bits for storing a single pixel of a video image; said storage means including means for storing the bit values generated by said encoding means in corresponding bits of the bit map memory array as said bit values are generated by said encoding means;

whereby a video image, received in the form of a raster scan video signal, is encoded and stored in a bit map memory array over a plurality of raster scan cycle periods.

2. The video image processing apparatus of claim 1, wherein said luminosity signal includes three separate color luminosity signals;

said encoding means includes means for separately encoding each of said color luminosity signals as a multibit binary value during different raster scan cycle periods; and said storing means includes means for storing, during each raster scan cycle period, at least one bit of said multibit binary value encoded by said encoding means in every element of the bit map memory array.

3. The video image processing apparatus of claim 2, wherein said encoding means includes means for cyclically encoding said color luminosity signals so that only one bit of each said multibit binary value changes in value when the intensity of the corresponding color luminosity signal changes by an amount corresponding to the value of the least significant bit of said multibit binary value.

4. The video image processing apparatus of claim 2, wherein said encoding means includes color offset means for adding a preselected binary value to the encoded binary value of each of said color luminosity signals before said encoded values are stored by said storing means;

whereby a preselected color represented by a preselected combination of encoded color luminosity values can be mapped into a second preselected combination of encoded color values which is used to represent transparent image areas.

5. The video image processing apparatus of claim 4, wherein said encoding means includes means for cyclically encoding each said color luminosity signal after said color offset means has added said preselected binary value to the encoded binary value of said color luminosity signal, so that only one bit of said encoded binary value changes in value when the intensity of the corresponding color luminosity signal changes by an amount corresponding to the value of the least significant bit of said encoded binary value.

6. A method of encoding and storing a video image in a bit map memeory array having a multiplicity of elements, each element of said array having a multiplicity of bits for storing a single pixel value representing the luminosity of one pixel in said video image; said method comprising the steps of:

continuously receining a video image in the form of a raster scan video signal and generating three color luminosity signals containing information representing the received video image; said raster scan video signal having a predefined raster scan cycle period during which time the raster scan video signal can be used to refresh the entire display of a raster scan display device;

in a preselected repeating sequence of raster scan cycles:

(a) generating during each raster scan cycle period encoded video information for every pixel in a video image carried by said raster scan video signal, including the step of encoding a corresponding one of said color luminosity signals so as to generate a multibit binary value for each said pixel; and (b) storing in said bit map memory array at least a preselected portion of said encoded video information for every pixel in said predefined array of pixel values as it is generated by said encoding means;

wherein said generating and storing steps generate and store a different set of bit values for every pixel in said video image during each of said preselected repeating sequence of raster scan cycles, so that said raster scan video signal is encoded and stored over a multiplicity of raster scan cycle periods.

7. The method of claim 6, wherein said encoding step includes cyclically encoding said color luminosity signals so that only one bit of said multibit binary value changes in value when the intensity of the corresponding color luminosity signal changes by an amount corresponding to the value of the least significant bit of said multibit binary value;

whereby the tendency of small changes in said raster scan video signal during the successive raster scan cycle periods during which a video image is encoded and stored to cause errors in the stored video image is minimized.

8. The method of claim 6, wherein said encoding step includes the step of adding a preselected binary value to the encoded binary value of each of said color luminosity signals before said encoded values are stored by said storing step;

whereby a preselected color represented by a preselected combination of encoded color luminosity values can be mapped into a second preselected combination of encoded color values which is used to represent transparent image areas.

9. The method of claim 8, wherein said encoding step further includes the step of cyclically encoding each said color luminosity signal after said step of adding said preselected binary value to the encoded binary value of said color luminosity signal, so that only one bit of said encoded binary value changes in value when the intensity of the corresponding color luminosity signal changes by an amount corresponding to the value of the least significant bit of said encoded binary value.

10. A video image processing system for receiving a video image in the form of a raster scan video signal and for encoding and for storing said video image in a bit map video memory coupled to said video image processing system, the raster scan video signal having a predefined raster scan cycle period during which time the raster scan video signal can be used to refresh the entire display of a raster scan display device;

said bit map video memory comprising a m by n by z array of binary memory bits, where m is the maximum width of the image measured in pixels, that can be stored in said video memory, n is the maximum height of the image, measured in pixels, that can be stored in said video memory, and z is the maximum number of bits which can be used to encode each said pixel of the image stored in said video memory; wherein each of said z bits for all of said pixels represents a bit plane across the image stored in said video memory, and wherein said video memory includes port means for simultaneously storing one bit of data in a preselected bit plane for each of a multiplicity of contiguous pixels;

said video image processing system comprising:

video receiving means for receiving a video image in the form of a raster scan video signal and generating a corresponding luminosity signal containing information representing the received video image;

encoding means coupled to said video receiving means for encoding the video image represented by said luminosity signal as an array of pixel values, each pixel value comprising a multiplicity of bit value, each bit value representing a portion of the information in said luminosity signal, including bit plane selection means for selecting, during each of a preselected number of sequential raster scan cycle periods, a corresponding one of said bit planes in said video memory; and partial encoding means for encoding, during each of said preselected number of sequential raster scan cycle periods, information in said luminosity signal corresponding to said selected bit plane; and storage means coupled to said encoding means for storing in said selected bit place of said video memory encoded video information as it is encoded by said encoding means;

whereby the information for a video image is encoded and stored over a plurality of raster scan cycle periods.

11. The video image processing system of claim 10, wherein said luminosity signal includes three separate color luminosity signals; and said encoding means includes means for separately encoding each of said color luminosity signals as a multibit binary value during different raster scan cycle periods.

12. The video image processing system of claim 11, wherein said encoding means includes means for cyclically encoding said color luminosity signals so that only one bit of each said multibit binary value changes in value when the intensity of the corresponding color luminosity signal changes by an amount corresponding to the value of the least significant bit of said multibit binary value.

13. The video image processing system of claim 11, wherein said encoding means includes color offset means for adding a preselected binary value to the encoded binary value of each of said color luminosity signals before said encoded values are stored by said storing means;

whereby a preselected color represented by a preselected combination of encoded color luminosity values can be mapped into a second preselected combination of encoded color values which is used to represent transparent image areas in said preselected computer.

14. The video image processing ystem of claim 13, wherein said encoding means includes means for cyclically encoding each said color luminosity signal after said color offset means has added said preselected binary value to the encoded binary value of said color luminosity signal, so that only one bit of each said multibit binary value changes in value when the intensity of the corresponding color luminosity signal changes by an amount corresponding to the value of the least significant bit of said multibit binary value.

15. The video image processing system of claim 10, wherein said bit map video memory is in a computer coupled to said video image processing system;

said encoding means includes counter means, coupled to said storage means, for generating a ready signal each time a set of video data of a predetermined size is encoded; and said storage means includes means for repetitively performing the steps of suspending the operation of said computer, and then responding to the receipt of said ready signal from said counter means by reenabling the operation of said computer and sending a set of encoded video data of said predetermined size from said encoding means to said computer for storage in said bit map video memory.

* * * * *